US010971055B2

(12) United States Patent
Hu

(10) Patent No.: US 10,971,055 B2
(45) Date of Patent: Apr. 6, 2021

(54) DISPLAY ADJUSTMENT METHOD AND DISPLAY DEVICE

(71) Applicant: HKC Corporation Limited, Guangdong (CN)

(72) Inventor: Shuixiu Hu, Guangdong (CN)

(73) Assignee: HKC Corporation Limited, Shenzhen (CN)

( * ) Notice: Subject to any disclaimer, the term of this patent is extended or adjusted under 35 U.S.C. 154(b) by 42 days.

(21) Appl. No.: 16/289,687

(22) Filed: Mar. 1, 2019

(65) Prior Publication Data

US 2020/0160773 A1 May 21, 2020

Related U.S. Application Data

(63) Continuation of application No. PCT/CN2018/121829, filed on Dec. 18, 2018.

(30) Foreign Application Priority Data

Nov. 21, 2018 (CN) ..... 201811395264.6

(51) Int. Cl.
*G09G 3/20* (2006.01)

(52) U.S. Cl.
CPC ..... *G09G 3/2074* (2013.01); *G09G 3/2003* (2013.01); *G09G 2300/0452* (2013.01); *G09G 2310/027* (2013.01); *G09G 2310/08* (2013.01)

(58) Field of Classification Search
CPC ..... G09G 5/026; G09G 5/02; G09G 2340/06; G09G 2340/0428; G09G 2310/027; G09G 2360/16; G09G 2360/145; G09G 2330/028; G09G 3/3607; G09G 3/3696; G09G 3/3406; G09G 3/20; G09G 3/3225; G09G 3/3291; G09G 3/2003; G09G 3/2007; G09G 3/2022; G09G 3/2011; G09G 3/3413; G09G 3/364; G09G 3/3648; G09G 3/007; G09G 3/2074; G09G 2320/0242; G09G 2320/0666; G09G 2320/0223; G09G 2320/0626; G09G 2320/0233; G09G 2320/0271; G09G 2320/028;

(Continued)

(56) References Cited

U.S. PATENT DOCUMENTS

2005/0062767 A1* 3/2005 Choe ..... G09G 3/3607 345/694
2007/0013979 A1* 1/2007 Nose ..... G09G 3/3685 358/519

(Continued)

FOREIGN PATENT DOCUMENTS

CN 1395229 A 2/2003
CN 1432987 A 7/2003

(Continued)

*Primary Examiner* — Nitin Patel
*Assistant Examiner* — Amen W. Bogale

(57) ABSTRACT

The present application discloses a display adjustment method and a display device. The method comprises steps of: obtaining a first pixel data of an image displayed by the display device; converting the first pixel data into a second pixel data after the first pixel data enters a timing controller; converting at least one of the second pixel data into sub-pixel data whose amount of stored data is reduced relative to the second pixel data to obtain a corresponding third pixel data; outputting the third pixel data.

18 Claims, 4 Drawing Sheets

(58) Field of Classification Search
CPC ..... G09G 2320/068; G09G 2320/04; G09G 2320/0673; G09G 2320/02; G09G 2320/0276; G09G 2300/0452; G09G 2300/0447; G09G 2300/0439; G09G 2300/0443; G09G 2320/285; G09G 2320/0646; G09G 236/16; G09G 2330/28; G02F 2011/134345; G06T 1/20; H04N 9/64
See application file for complete search history.

(56) References Cited

U.S. PATENT DOCUMENTS

| | | | | |
|---|---|---|---|---|
| 2009/0060377 | A1* | 3/2009 | Chen | G06T 5/40 382/270 |
| 2010/0309234 | A1* | 12/2010 | Lee | G09G 3/3607 345/690 |
| 2011/0134152 | A1* | 6/2011 | Furihata | G09G 3/3648 345/690 |
| 2012/0281030 | A1* | 11/2012 | Miyata | G09G 3/3614 345/690 |
| 2014/0146097 | A1* | 5/2014 | Kimura | G09G 3/3648 345/690 |
| 2014/0160174 | A1 | 6/2014 | Tsuei et al. | |
| 2016/0232859 | A1* | 8/2016 | Oh | G09G 3/3611 |
| 2018/0336853 | A1* | 11/2018 | Nakajima | G09G 3/2051 |
| 2019/0392769 | A1* | 12/2019 | Lee | G09G 3/3225 |
| 2020/0219432 | A1* | 7/2020 | Park | G09G 3/3233 |

FOREIGN PATENT DOCUMENTS

| | | | |
|---|---|---|---|
| CN | 101986380 | A | 3/2011 |
| CN | 103561253 | A | 2/2014 |
| CN | 103761933 | A | 4/2014 |
| CN | 106713654 | A | 5/2017 |
| CN | 107799079 | A | 3/2018 |
| JP | 2000115802 | A | 4/2000 |
| JP | 2011215479 | A | 10/2011 |
| WO | 2013108646 | A1 | 7/2013 |

* cited by examiner

DISPLAY ADJUSTMENT METHOD AND DISPLAY DEVICE

CROSS REFERENCE TO RELATED APPLICATIONS

The present application is a Continuation Application of PCT Application No. PCT/CN2018/121829 filed on Dec. 18, 2018, which claims the benefit of Chinese Patent Application No. 201811395264.6 filed on Nov. 21, 2018. All the above are hereby incorporated by reference.

FIELD OF THE DISCLOSURE

The present application relates to the technical field of display, in particular, to a display adjustment method and a display device.

BACKGROUND OF THE DISCLOSURE

The reason why the display device can display different colors and images is mainly because the display panel contains a lot of R (red), G (green), B (blue) sub-pixels. These three sub-pixels can display different colors at different brightnesses. However, since the wavelength of the B sub-pixel is short, the attenuation of the B sub-pixel is much smaller than that of the R sub-pixel and the G sub-pixel, resulting in a display image of the display device being cold. The cool color is not suitable for Asians to watch, so it can be achieved by white tracking technology, which increases the brightness of the R sub-pixels and reduces the brightness of the B sub-pixels, thereby weakening the phenomenon of coldness of the image. The current white tracking technology is implemented by converting 8-bit into 10 bits, but this method takes up the storage space inside the IC (chip) and increases the cost of the IC.

SUMMARY OF THE DISCLOSURE

The main purpose of the present application is to provide a display adjustment method and a display device, which aim to save the storage space of the chip and reduce the cost of the chip.

In order to achieve the above purpose, the present application provides a display adjustment method comprising steps of:

obtaining a first pixel data of an image displayed by the display device;

converting the first pixel data into a second pixel data after the first pixel data enters a timing controller, wherein the amount of stored data of the second pixel data is greater than the amount of stored data of the first pixel data;

converting at least one of the second pixel data into sub-pixel data whose amount of stored data is reduced relative to the second pixel data to obtain a corresponding third pixel data; and outputting the third pixel data.

In order to achieve the above purpose, the present application further provides a display adjustment method comprising steps of:

obtaining a first pixel data of an image displayed by the display device;

converting the first pixel data into a second pixel data after the first pixel data enters a timing controller, wherein the amount of stored data of the second pixel data is greater than the amount of stored data of the first pixel data;

calculating a gray-scale difference between the first sub-pixel data and the second sub-pixel data in the second pixel data, and a gray-scale difference between the second sub-pixel data and the third sub-pixel data;

obtaining a corresponding third pixel data according to each of the gray-scale differences and the third sub-pixel data; and outputting the third pixel data.

In order to achieve the above purpose, the present application further provides a display device, wherein the display device comprises a memory, a processor, and a display adjustment program stored on the memory and operable on the processor, the processor executing the display adjustment program to implement the steps of:

obtaining a first pixel data of an image displayed by the display device;

converting the first pixel data into a second pixel data after the first pixel data enters a timing controller, wherein the amount of stored data of the second pixel data is greater than the amount of stored data of the first pixel data;

converting at least one of the second pixel data into sub-pixel data whose amount of stored data is reduced relative to the second pixel data to obtain a corresponding third pixel data; and outputting the third pixel data.

In the technical solution of the present application, by reducing the amount of stored data of at least one of the second pixel data in the timing controller, the storage space of the chip may be effectively reduced, and the cost of the chip may be reduced.

BRIEF DESCRIPTION OF THE DRAWINGS

To illustrate the technical solutions according to the embodiments of the present disclosure more clearly, the accompanying drawings for describing the embodiments are introduced briefly in the following. Apparently, the accompanying drawings in the following description are only about some embodiments of the present disclosure, and persons of ordinary skill in the art can derive other drawings from the accompanying drawings without creative efforts.

DETAILED DESCRIPTION OF THE EMBODIMENTS

It should be understood that the specific embodiments described herein are only for illustrating but not for limiting the present application.

The main solution of the embodiment of the present application is: obtaining a first pixel data of an image displayed by the display device; converting the first pixel data into a second pixel data after the first pixel data enters a timing controller; converting at least one of the second pixel data into sub-pixel data whose amount of stored data is reduced relative to the second pixel data to obtain a corresponding third pixel data; outputting the third pixel data.

In the technical solution of the present application, by reducing the amount of stored data of the second pixel data in the timing controller, the storage space of the chip may be effectively reduced, and the cost of the chip may be reduced.

Figure 1:
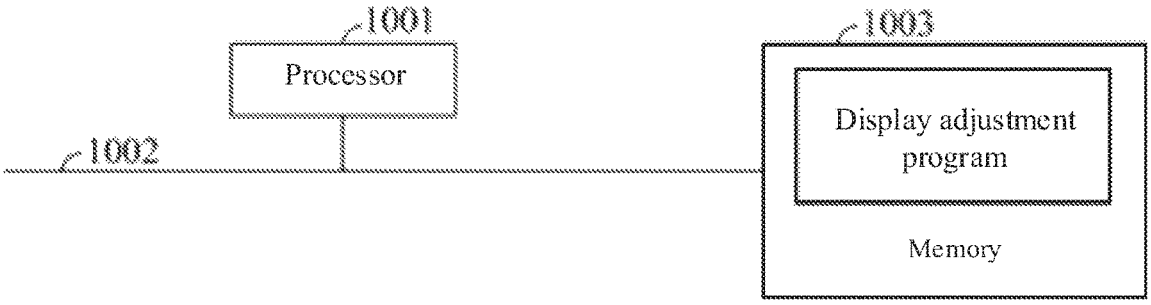
FIG. 1 is a structural view of a display device in a hardware running environment according to a solution in an embodiment of the present application.

As an embodiment, the display device may be as shown in FIG. 1.

The solution of the embodiment of the present application relates to a display device, where the display device includes: a processor 1001, such as a CPU, a communication bus 1002, and a memory 1003. Among them, the communication bus 1002 is used to realize connection and communication between the assemblies.

The memory 1003 may be a high-speed RAM memory, and can also be a non-volatile memory, such as a magnetic disk memory. As shown in FIG. 1, a display adjustment program may be included in the memory 1003 as a computer storage medium; the processor 1001 may be used to invoke the display adjustment program stored in the memory 1003 and perform the following operations:

obtaining a first pixel data of an image displayed by the display device;

converting the first pixel data into a second pixel data after the first pixel data enters a timing controller, wherein the amount of stored data of the second pixel data is greater than the amount of stored data of the first pixel data;

converting at least one of the second pixel data into sub-pixel data whose amount of stored data is reduced relative to the second pixel data to obtain a corresponding third pixel data;

outputting the third pixel data.

Optionally, the processor 1001 may be used to invoke the display adjustment program stored in the memory 1003 and perform the following operations:

treating one sub-pixel data in the second pixel data as a reference sub-pixel data, and treating other sub-pixel data as a target sub-pixel data;

calculating a gray-scale difference between each of the target sub-pixel data and the reference sub-pixel data, and obtaining a corresponding third pixel data according to the gray-scale difference and the reference sub-pixel data.

Optionally, the processor 1001 may be used to invoke the display adjustment program stored in the memory 1003 and perform the following operations:

performing difference between each of the target sub-pixel data and the reference sub-pixel data to obtain a corresponding plurality of gray-scale differences;

converting each of the gray-scale differences into a gray-scale difference whose amount of the stored data is reduced relative to the second pixel data;

treating the converted plurality of gray-scale differences and the reference sub-pixel data as a third pixel data.

Optionally, the processor 1001 may be used to invoke the display adjustment program stored in the memory 1003 and perform the following operations:

treating two sub-pixel data in the second pixel data as a reference sub-pixel data, and treating other sub-pixel data as a target sub-pixel data;

calculating a gray-scale difference between the target sub-pixel data and one of the reference sub-pixel data, and obtaining a corresponding third pixel data according to the gray-scale difference and the reference sub-pixel data.

Optionally, the processor 1001 may be used to invoke the display adjustment program stored in the memory 1003 and perform the following operations:

performing difference between the target sub-pixel data and one of the reference sub-pixel data to obtain a corresponding gray-scale difference;

converting the gray-scale difference into a gray-scale difference whose amount of the stored data is reduced relative to the second pixel data;

treating the converted gray-scale difference and the reference sub-pixel data as a third pixel data.

Optionally, the processor 1001 may be used to invoke the display adjustment program stored in the memory 1003 and perform the following operations:

obtaining a first pixel data of an image displayed by the display device;

converting the first pixel data into a second pixel data after the first pixel data enters a timing controller, wherein the amount of stored data of the second pixel data is greater than the amount of stored data of the first pixel data;

calculating a gray-scale difference between the first sub-pixel data and the second sub-pixel data in the second pixel data, and a gray-scale difference between the second sub-pixel data and the third sub-pixel data; wherein the corresponding gray-scale of the first sub-pixel data is greater than the corresponding gray-scale value of the second sub-pixel data, and the corresponding gray-scale of the second sub-pixel data is greater than the corresponding gray-scale of the third sub-pixel data;

obtaining a corresponding third pixel data according to each of the gray-scale differences and the third sub-pixel data;

outputting the third pixel data.

Optionally, the processor 1001 may be used to invoke the display adjustment program stored in the memory 1003 and perform the following operations:

converting the gray-scale difference into a gray-scale difference whose amount of the stored data is reduced relative to the second pixel data;

treating the converted gray-scale difference and the third sub-pixel data as a third pixel data.

Optionally, the processor 1001 may be used to invoke the display adjustment program stored in the memory 1003 and perform the following operations:

the gray-scale difference between the first sub-pixel data and the second sub-pixel data is non-negative, and the gray-scale difference between the second sub-pixel data and the third sub-pixel data is non-negative.

Figure 2:
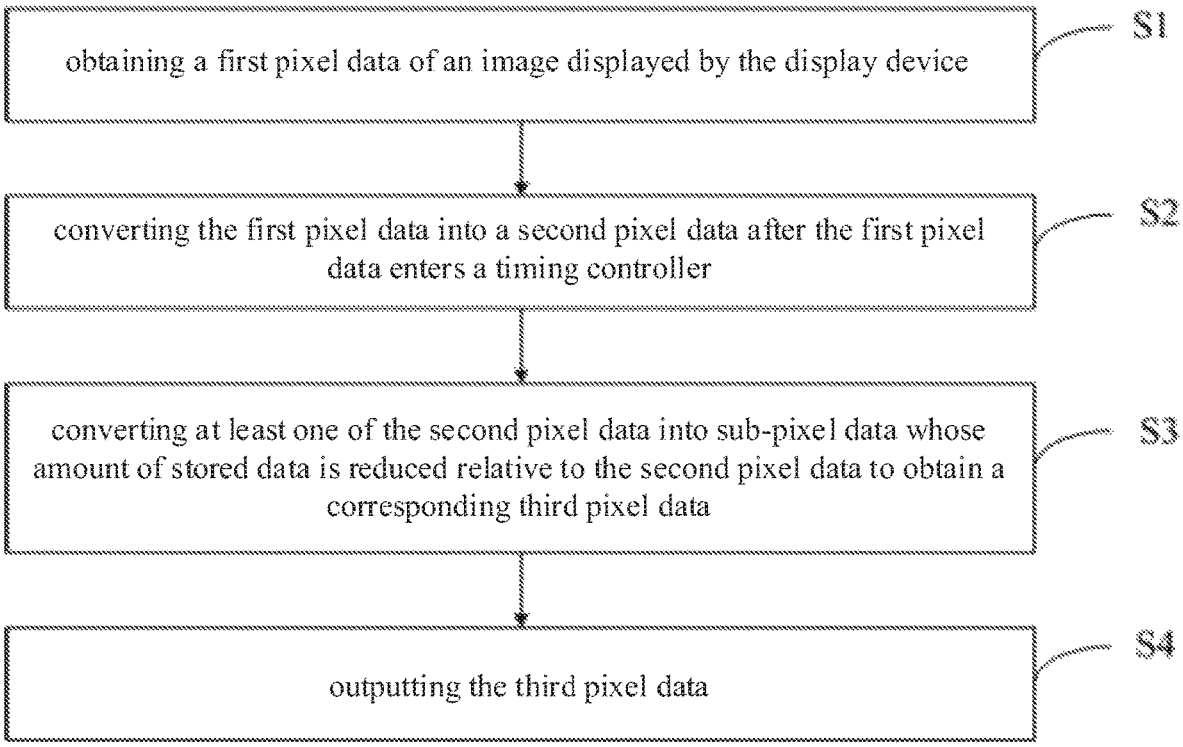
FIG. 2 is a flow chart of an embodiment of the display adjustment method of the present application.

FIG. 2 is a flow chart of an embodiment of the display adjustment method of the present application;

In the present embodiment, the display adjustment method comprises:

step S1, obtaining a first pixel data of an image displayed by the display device;

The display device may be a display device having a display panel, such as a television, a tablet, or a mobile phone. The image displayed by the display device is formed by a plurality of pixels that may display different colors. Among them, each pixel includes an R (red) sub-pixel, a G (green) sub-pixel, and a B (blue) sub-pixel. Each gray-scale of the R sub-pixel is stored in 8 bits, each gray-scale of the G sub-pixel is stored in 8 bits, and each gray-scale of the B sub-pixel is stored in 8 bits, to obtain corresponding three groups of sub-pixel data represented by 8 bits, that is, the first pixel data.

Step S2, converting the first pixel data into a second pixel data after the first pixel data enters a timing controller;

the timing controller may be used to adjust the color temperature to improve the coldness of the display image. The processing method includes increasing a gray-scale of the R sub-pixel in each pixel and/or decreasing a gray-scale of the B sub-pixel. Specifically, after receiving three groups of first pixel data composed of sub-pixel data represented by 8 bits, the timing controller re-adjusts the gray-scales of the R, G, and B sub-pixels in the first pixel data. The adjustment method includes increasing the gray-scale of the R sub-pixel in each pixel and/or decreasing the gray-scale of the B sub-pixel in each pixel. For example, before entering the timing controller, the gray-scales of the R, G, and B sub-pixels corresponding to the gray-scale data 3 are 3, 3, and 3, respectively, and after entering the timing controller, the gray-scales of the R, G, and B sub-pixels are adjusted to 14, 13, and 12. For another example, the gray-scales of the R, G, and B sub-pixels corresponding to the gray-scale data 254 are 254, 254, and 254, respectively, and after entering the timing controller, the gray-scales of the R, G, and B sub-pixels are adjusted to 1014, 1012, and 968. Since one bit may not store the gray-scale of the sub-pixel re-adjusted by the timing controller, each gray-scale of each sub-pixel is stored in 10 bits, thereby obtaining three groups of sub-pixel data represented by 10 bits, and the three groups of sub-pixel data represented by 10 bits are the second pixel data.

Step S3, converting at least one of the second pixel data into sub-pixel data whose amount of stored data is reduced relative to the second pixel data to obtain a corresponding third pixel data;

After the adjusted second pixel data represented by 10 bits is obtained, in order to reduce the storage space of the chip, a group of sub-pixel data or two groups of sub-pixel data of the R sub-pixel data, the G sub-pixel data, or the B sub-pixel data represented by 10 bits in the second pixel data may be converted into a sub-pixel data with a relatively reduced amount of stored data, that is, a sub-pixel data whose data bits are reduced. For example, three groups of R, G, B sub-pixel data represented by 10 bits may be converted into a sub-pixel data represented by 7 bits, or two groups of sub-pixel data in the three groups of sub-pixel data of R, G, and B may be converted into a sub-pixel data represented by 7 bits. The conversion method may be implemented according to certain calculation rules. The converted sub-pixel data and the unconverted sub-pixel data are treated as a third pixel data.

Step S4, outputting the third pixel data.

After one or two groups of sub-pixel data in the second pixel data into sub-pixel data whose amount of stored data is reduced, a corresponding third pixel data is obtained, and the timing controller outputs the corresponding third pixel data.

In the technical solution of the present application, by converting the second pixel data in the timing controller into a third pixel data whose amount of stored data is reduced, the storage space of the chip may be effectively reduced, the amount of computation inside the chip may be reduced and the cost of the chip may be effectively reduced.

Figure 3:
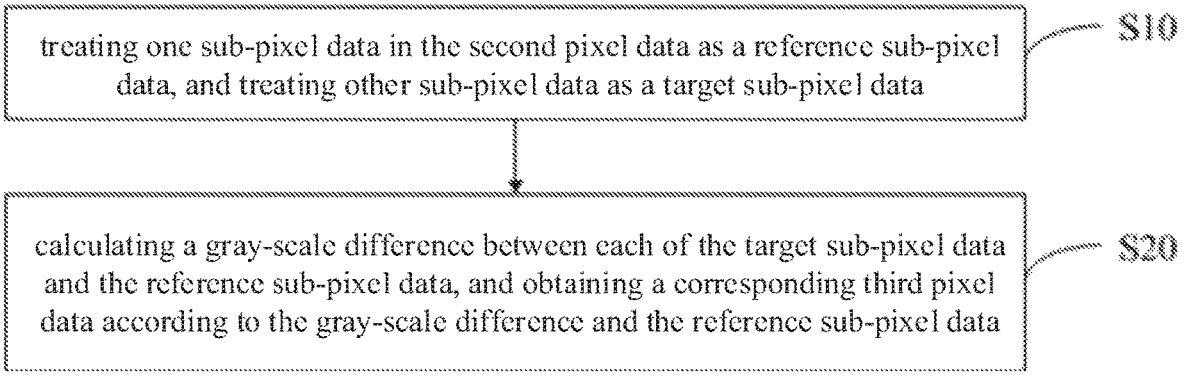
FIG. 3 is a detailed flow chart of the step S3 in an embodiment of the present application.

Referring to FIG. 3, in an embodiment, based on the above embodiments, step S3 includes:

step S10, treating one sub-pixel data in the second pixel data as a reference sub-pixel data, and treating other sub-pixel data as a target sub-pixel data;

Based on the above embodiments, in the present embodiment, one sub-pixel data in the second pixel data may be treated as a reference sub-pixel data, and other sub-pixel data may be treated as a target sub-pixel data, that is, one group of sub-pixel data of the three groups of sub-pixel data is treated as a reference sub-pixel data, and the other two groups of sub-pixel data are treated as a target sub-pixel data. For example, one group of R sub-pixel data is treated as a reference sub-pixel data, and other two groups of sub-pixel data are treated as a target sub-pixel data; or, one group of G sub-pixel data is treated as a reference sub-pixel data, and other two groups of sub-pixel data are treated as a target sub-pixel data; or, one group of B sub-pixel data is treated as a reference sub-pixel data, and other two groups of sub-pixel data are treated as a target sub-pixel data.

Figure 4:
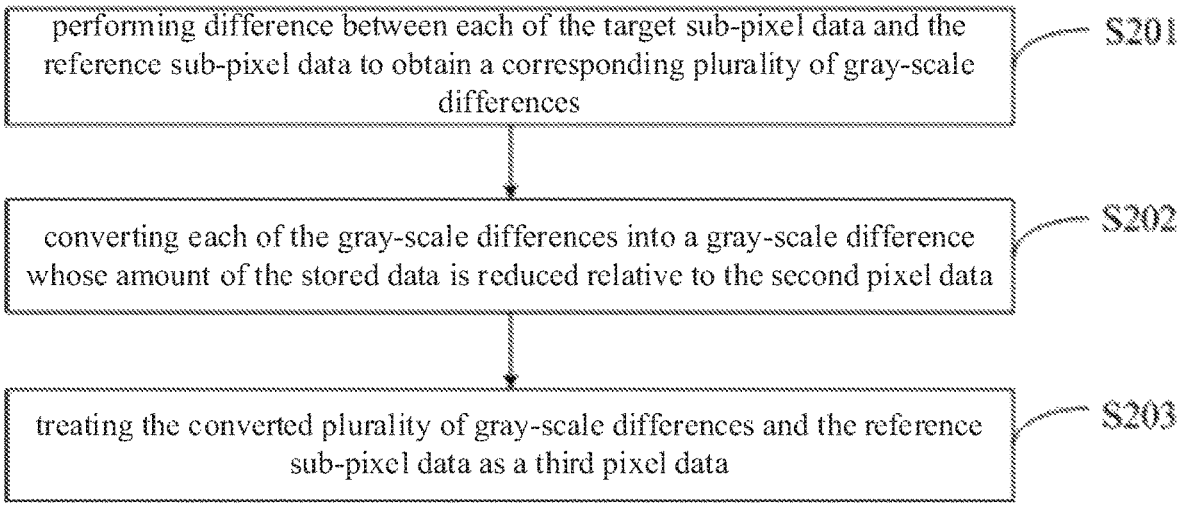
FIG. 4 is a detailed flow chart of the step S20 in an embodiment of the present application.

Step S20, calculating a gray-scale difference between each of the target sub-pixel data and the reference sub-pixel data, and obtaining a corresponding third pixel data according to the gray-scale difference and the reference sub-pixel data;

After the reference sub-pixel data and the target sub-pixel data are determined, a gray-scale difference between each target sub-pixel and the reference sub-pixel corresponding to each level of gray-scale data is calculated to obtain a gray-scale difference between each target sub-pixel and the reference sub-pixel under each level of gray-scale data; the corresponding gray-scale difference is treated as a new gray-scale of the target sub-pixel under the gray-scale data, and the amount of stored data in each new gray-scale of each target sub-pixel is reduced; then, the target sub-pixel data whose the amount of stored data is reduced and the reference sub-pixel data whose the amount of stored data are unchanged are treated as the third pixel data. Specifically, referring to FIG. 4, the step S20 includes:

step S201, performing difference between each of the target sub-pixel data and the reference sub-pixel data to obtain a corresponding plurality of gray-scale differences;

After a gray-scale difference between each target sub-pixel and the reference sub-pixel corresponding to each level of gray-scale data is calculated to obtain a gray-scale difference between each target sub-pixel and the reference sub-pixel under each level of gray-scale data, the corresponding gray-scale difference may be treated as a new gray-scale of the target sub-pixel under the gray-scale data. For example, the gray-scales of the R, G, and B sub-pixels corresponding to the gray-scale data 1 are 8, 6, and 6, respectively. If the R sub-pixel data is treated as the reference sub-pixel data, the gray-scale difference between the G sub-pixel and the R sub-pixel under the gray-scale data 1 is −2; if −2 is treated as the new gray-scale of the G sub-pixel under the gray-scale data 1, the gray-scale difference between the B sub-pixel and the R sub-pixel under the gray-scale data 1 is −2; if −2 is treated as the new gray-scale of the B sub-pixel under the gray-scale data 1, similarly, a new gray-scale corresponding to each target sub-pixel under each level of the gray-scale data is calculated.

Step S202, converting each of the gray-scale differences into a gray-scale difference whose amount of the stored data is reduced relative to the second pixel data;

a plurality of new gray-scales of the target sub-pixel through the above steps; since the new gray-scale of the target sub-pixel is small, it is not necessary to use 10 bits for storage to avoid wasting the storage space of the chip too much; therefore, each new gray-scale corresponding to the target sub-pixel may be represented by 7 bits, that is, the amount of stored data for each new gray-scale of the target sub-pixel is converted from 10 bits to 7 bits; wherein since the gray-scale difference may have a negative value, the data first digit may be used as a sign digit, e.g., if the gray-scale difference is −62, represented in 7 bits, it may be represented as 011 1110, and if the gray-scale difference is 62, it may be represented as 1111110; the first digit 0, 1 is used to indicate a negative or positive value. It should be noted that since the first digit of 7 bits is used to represent the sign digit, the present embodiment is only applicable to values in which the gray-scale difference is in the range of −63 to 63. In practical applications, in order to avoid the display image of the display panel being cold or warm, the gray-scale difference between the R, G, and B sub-pixels corresponding to the same gray-scale data is generally not excessive.

Step S203, treating the converted plurality of gray-scale differences and the reference sub-pixel data as a third pixel data;

After each new gray-scale of the target sub-pixel is represented by 7 bits, two groups of sub-pixel data represented by 7 bits and one group of sub-pixel data represented by 10 bits are obtained, respectively; then, two groups of sub-pixel data represented by 7 bits and one group of sub-pixel data represented by 10 bits are treated as the third pixel data.

In the technical solution of the present application, by converting the amount of stored data of the two groups of sub-pixel data of the second pixel data in the timing controller from 10 bits to 7 bits, the storage space of the chip may be significantly reduced and the cost of the chip may be effectively reduced.

Figure 5:
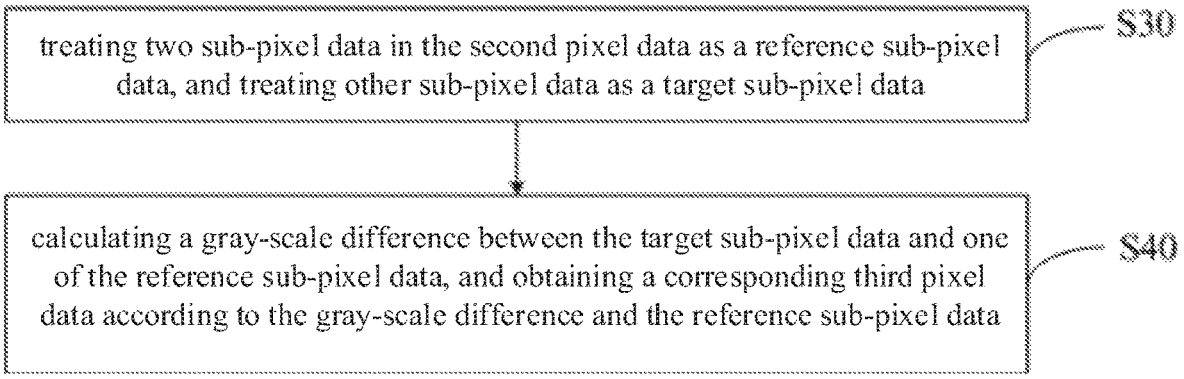
FIG. 5 is another detailed flow chart of the step S3 in an embodiment of the present application.

Referring to FIG. 5, in an embodiment, based on the above embodiments, step S3 includes:

step S30, treating two sub-pixel data in the second pixel data as a reference sub-pixel data, and treating other sub-pixel data as a target sub-pixel data;

based on the above embodiments, in the present embodiment, two sub-pixel data in the second pixel data are treated as a reference sub-pixel data, and other one sub-pixel data is treated as a target sub-pixel data, that is, two groups of sub-pixel data of the three groups of sub-pixel data are treated as a reference sub-pixel data, and the other one group of sub-pixel data is treated as a target sub-pixel data. For example, one group of R sub-pixel data and one group of G sub-pixel data are treated as a reference sub-pixel data, and B sub-pixel data is treated as a target sub-pixel data; or, one group of G sub-pixel data and one group of B sub-pixel are treated as a reference sub-pixel data, and R sub-pixel data is treated as a target sub-pixel data; or, one group of R sub-pixel data and one group of B sub-pixel are treated as a reference sub-pixel data, and other one group of G sub-pixel data is treated as a target sub-pixel data.

Step S40, calculating a gray-scale difference between the target sub-pixel data and one of the reference sub-pixel data, and obtaining a corresponding third pixel data according to the gray-scale difference and the reference sub-pixel data.

Figure 6:
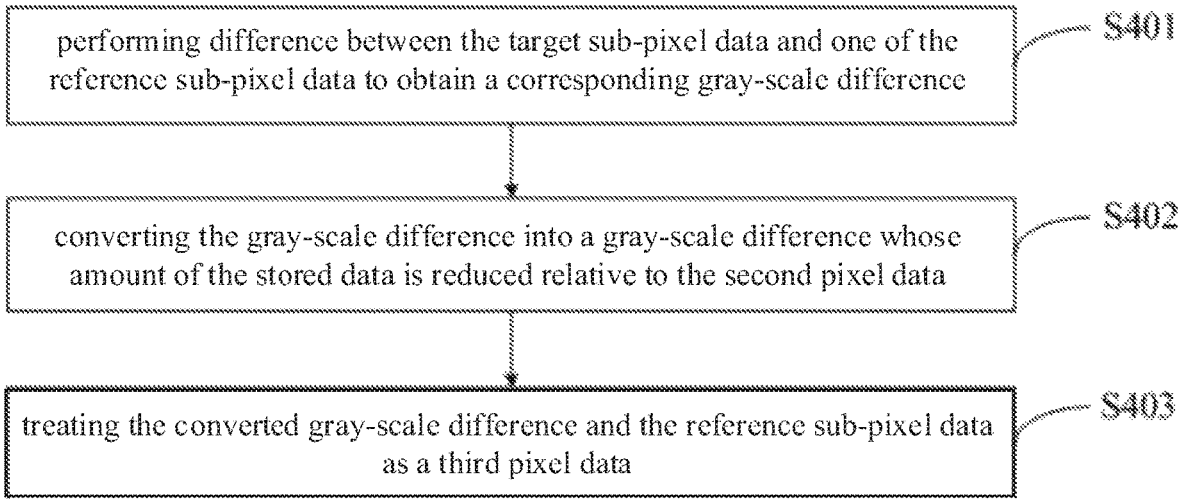
FIG. 6 is a detailed flow chart of the step S40 in an embodiment of the present application.

After the reference sub-pixel data and the target sub-pixel data are determined, a gray-scale difference between each target sub-pixel and the reference sub-pixel corresponding to each level of gray-scale data is calculated, and the obtained gray-scale difference is treated as a new gray-scale of the target sub-pixel under the gray-scale data; after a new gray-scale of the target sub-pixel corresponding to each level of gray-scale data, the amount of stored data of the new gray-scale corresponding to the target sub-pixel is reduced, and the target sub-pixel data whose amount of stored data is reduced and the reference sub-pixel data whose amount of stored data are unchanged are used as the third pixel data. Specifically, referring to FIG. 6, the step S40 includes:

step S401, performing difference between the target sub-pixel data and one of the reference sub-pixel data to obtain a corresponding gray-scale difference;

A gray-scale difference between the target sub-pixel and the reference sub-pixel corresponding to each level of gray-scale data is calculated to obtain a gray-scale difference between the target sub-pixel and the reference sub-pixel under each level of gray-scale data, and the gray-scale difference is treated as a new gray-scale of the target sub-pixel under the gray-scale data. Among them, the gray-scale difference may be calculated by selecting one group of sub-pixel data in two groups of reference sub-pixel data according to actual needs. After the gray-scale difference is calculated by determining one group of reference sub-pixel data, when the gray-scale difference between the target sub-pixel and the reference sub-pixel under each level of gray-scale data is calculated, the same group of reference sub-pixel data is taken to calculate the gray-scale difference, but not alternately. For example, in an embodiment, the gray-scales of the R, G, and B sub-pixels corresponding to the gray-scale data 1 are 8, 6, and 6, respectively. If the R sub-pixel data is treated as the reference sub-pixel data and the G sub-pixel data as the target sub-pixel data, the gray-scale difference between the G sub-pixel data and the R sub-pixel data under the gray-scale data 1 is −2; if −2 is treated as the new gray-scale of the G sub-pixel data under the gray-scale data 1, when the gray-scale difference between the target sub-pixel and the reference sub-pixel under the next level of gray-scale data is calculated, the new gray-scale value of the G sub-pixel under the gray-scale data is still calculated by using the R sub-pixel as the reference sub-pixel; similarly, a new gray-scale corresponding to the target sub-pixel under each level of the gray-scale data is calculated. In other embodiments, the B sub-pixel data may also be selected as a reference, which is not limited herein.

Step S402, converting the gray-scale difference into a gray-scale difference whose amount of the stored data is reduced relative to the second pixel data;

after the new gray-scale corresponding to the target sub-pixel under each level of the gray-scale data is calculated, since the new gray-scale of the target sub-pixel data is small, it is not necessary to use 10 bits to represent too much wasted chip storage space; therefore, each new gray-scale of the target sub-pixel may be represented by 7 bits, that is, each new gray-scale of the target sub-pixel is converted from 10 bits to 7 bits; wherein since the gray-scale difference may have a negative value, the data first digit may be used as a sign digit, e.g., if the gray-scale difference is −62, represented in 7 bits, it may be represented as 011 1110; the first digit 0 is used to indicate a negative value. Since the first digit of 7 bits is used to represent the sign digit, the present embodiment is only applicable to values in which the gray-scale difference is in the range of −63 to 63. In practical applications, in order to avoid the display image of the display panel being cold or warm, the gray-scale difference between each sub-pixel corresponding to the same gray-scale data is generally not excessive.

Step S403, treating the converted gray-scale difference and the reference sub-pixel data as a third pixel data.

After each new gray-scale corresponding to the target sub-pixel data is represented by 7 bits, two groups of sub-pixel data represented by 10 bits and one group of sub-pixel data represented by 7 bits are obtained; then, two groups of sub-pixel data represented by 10 bits and one group of sub-pixel data represented by 7 bits are treated as the third pixel data.

In the technical solution of the present application, by converting one group sub-pixel data of the second pixel data in the timing controller from 10 bits to 7 bits, the storage space of the chip may be effectively reduced and the amount of computation inside the chip is reduced, thereby effectively reducing the cost.

Figure 7:
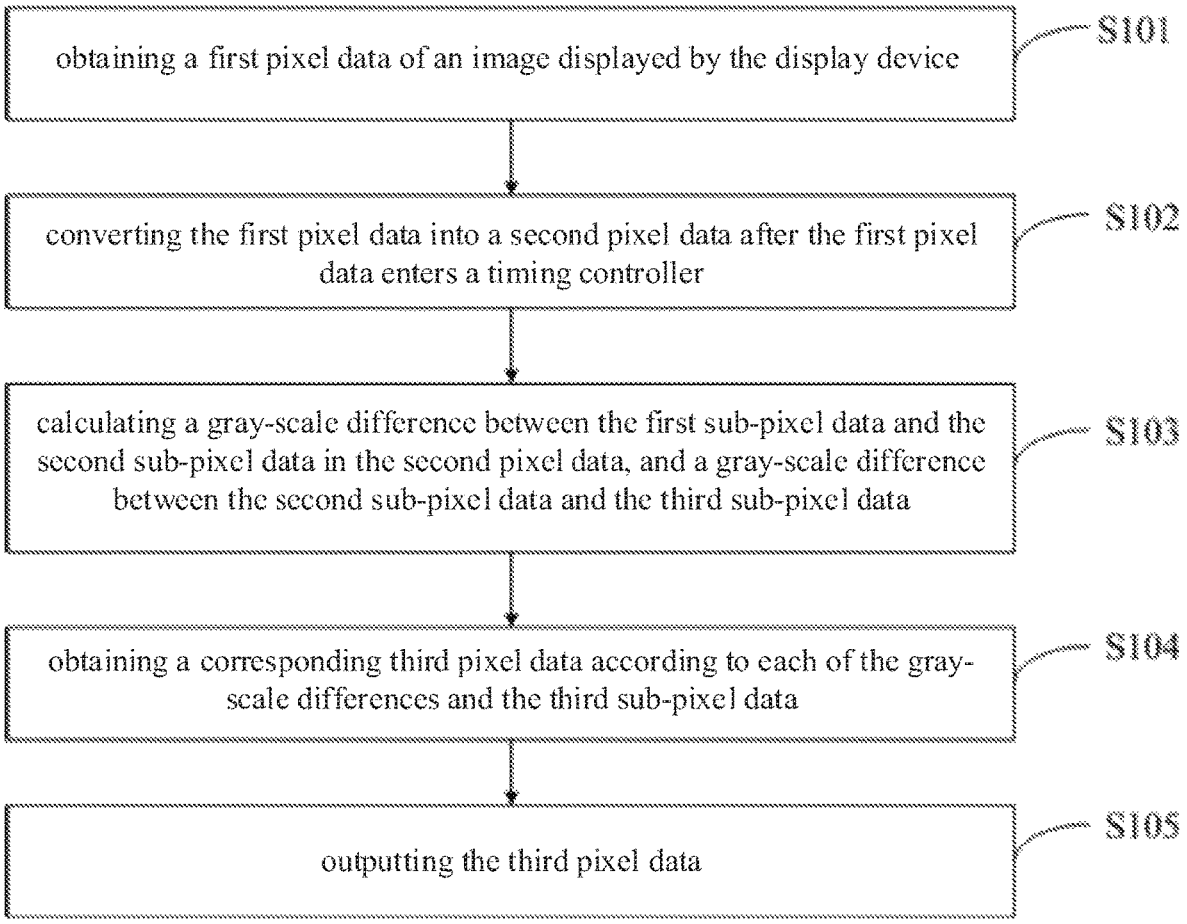
FIG. 7 is a flow chart of another embodiment of the display adjustment method of the present application.

FIG. 7 is a flow chart of another embodiment of the display adjustment method of the present application;

in the present embodiment, the display adjustment method comprises:

step S101, obtaining a first pixel data of an image displayed by the display device;

the display device may be a display device having a display panel, such as a television, a tablet, or a mobile phone. The image displayed by the display device is formed by a plurality of pixels that may display different colors. Among them, each pixel includes an R (red) sub-pixel, a G (green) sub-pixel, and a B (blue) sub-pixel. Each gray-scale of the R sub-pixel is stored in 8 bits, each gray-scale of the G sub-pixel is stored in 8 bits, and each gray-scale of the B sub-pixel is stored in 8 bits, to obtain corresponding three groups of sub-pixel data represented by 8 bits, that is, the first pixel data.

Step S102, converting the first pixel data into a second pixel data after the first pixel data enters a timing controller;

the timing controller may be used to adjust the color temperature to improve the coldness of the display image. The processing method includes increasing a gray-scale of the R sub-pixel in each pixel and/or decreasing a gray-scale of the B sub-pixel. Specifically, after receiving three groups of first pixel data composed of sub-pixel data represented by 8 bits, the timing controller re-adjusts the gray-scales of the R, G, and B sub-pixels in the first pixel data. The adjustment method includes increasing the gray-scale of the R sub-pixel in each pixel and/or decreasing the gray-scale of the B sub-pixel in each pixel. For example, before entering the timing controller, the gray-scales of the R, G, and B sub-pixels corresponding to the gray-scale data 3 are 3, 3, and 3, respectively, and after entering the timing controller, the gray-scales of the R, G, and B sub-pixels are adjusted to 14, 13, and 12. For another example, the gray-scales of the R, G, and B sub-pixels corresponding to the gray-scale data 254 are 254, 254, and 254, respectively, and after entering the timing controller, the gray-scales of the R, G, and B sub-pixels are adjusted to 1014, 1012, and 968. Since one bit may not store the gray-scale of the sub-pixel re-adjusted by the timing controller, the gray-scale of each sub-pixel is stored in 10 bits, thereby obtaining three groups of sub-pixel data represented by 10 bits, and the three groups of sub-pixel data represented by 10 bits are the second pixel data.

Step S103, calculating a gray-scale difference between the first sub-pixel data and the second sub-pixel data in the second pixel data, and a gray-scale difference between the second sub-pixel data and the third sub-pixel data;

In the present embodiment, the R sub-pixel data is treated as the first sub-pixel data, the G sub-pixel data is treated as the second sub-pixel data, and the B sub-pixel data is treated as the third sub-pixel data. In practical applications, after the pixel data is re-adjusted by the timing controller, the gray-scale of the R sub-pixel is the largest and the gray-scale of the B sub-pixel is the smallest under each level of gray-scale data. In the present embodiment, the gray-scale difference between the R sub-pixel and the G sub-pixel under each level of gray-scale data is calculated as a new gray-scale corresponding to the R sub-pixel, and the gray-scale difference between the G sub-pixel and the B sub-pixel under each level of gray-scale data is calculated as a new gray-scale corresponding to the G sub-pixel data. For example, in an embodiment, the gray scales of the R, G, and B sub-pixels under gray-scale data 5 are 21, 18, and 17, respectively; a difference between 21 and 18 is calculated to obtain a new gray-scale 3 for the R sub-pixel under gray-scale data 5; a difference between 18 and 17 is calculated to obtain a new gray-scale 1 for the G sub-pixel under gray-scale data 5; similarly, a new gray-scale corresponding to the first sub-pixel and a new gray-scale corresponding to the second sub-pixel under each level of gray-scale data are calculated.

Step S104, obtaining a corresponding third pixel data according to each of the gray-scale differences and the third sub-pixel data;

after the new gray-scale corresponding of the first sub-pixel and the second sub-pixel under each level of the gray-scale data are calculated, since the new gray-scale of the first sub-pixel and the second sub-pixel is small, it is not necessary to use 10 bits to represent too much wasted chip storage space; therefore, each new gray-scale corresponding to the R sub-pixel may be represented by 7 bits, and each new gray-scale corresponding to the G sub-pixel may be represented by 7 bits. Among them, since the gray scale of the R sub-pixel is the largest and the gray scale of the B sub-pixel is the smallest under each gray scale data, each new gray-scale of the R sub-pixel and each new gray-scale of the G sub-pixel are non-negative, i.e., 0 or a positive number, so that no reserved sign digit is required. Therefore, the solution of the present embodiment is applicable to values in which the gray-scale difference does not exceed 127. After each new gray-scale of the R sub-pixel and the G sub-pixel in the second pixel data is converted from 10 bits to 7 bits, two groups of sub-pixel data represented by 7 bits and one group of sub-pixel data represented by 10 bits are obtained; then, two groups of sub-pixel data represented by 7 bits and one group of sub-pixel data represented by 10 bits are treated as a third pixel data.

Step S105, outputting the third pixel data.

After a corresponding third pixel data is obtained, the timing controller outputs the corresponding third pixel data.

In the technical solution of the present application, by reducing the amount of stored data of the first sub-pixel data and the second sub-pixel data in the second pixel data in the timing controller from 10 bits to 7 bits, the storage space of the chip may be saved and the amount of computation inside the chip is reduced, thereby effectively reducing the cost of the chip.

The present application further provides a display device, wherein the display device comprises a memory, a processor, and a display adjustment program stored on the memory and operable on the processor, the processor executing the display adjustment program to implement the steps of the display adjustment method as described above.

The display device of the present embodiment may be a display device having a display panel, such as a television, a tablet, or a mobile phone.

The descriptions above are only the alternative embodiments of the present application, but not intended to limit the patent scope of the present application. Any equivalent structural variations made by utilizing the specification and drawings of the present application under the inventive concept of the present application, or direct or indirect applications in other related technical fields should be concluded in the patent protection scope of the present application.

What is claimed is:

1. A display adjustment method, wherein the display adjustment method comprises the steps of:

obtaining a first pixel data of an image displayed by the display device;

converting the first pixel data into a second pixel data after the first pixel data enters a timing controller, wherein the amount of stored data of the second pixel data is greater than the amount of stored data of the first pixel data;

converting at least one of the second pixel data into sub-pixel data whose amount of stored data is reduced relative to the second pixel data to obtain a corresponding third pixel data; and outputting the third pixel data, and wherein the step of converting at least one of the second pixel data into sub-pixel data whose amount of stored data is reduced relative to the second pixel data to obtain a corresponding third pixel data comprises:

treating at least one sub-pixel data in the second pixel data as reference sub-pixel data, and treating other sub-pixel data as a target sub-pixel data; and calculating a gray-scale difference between each of the target sub-pixel data and one of the reference sub-pixel data, and replacing the each of the target sub-pixel data with the gray-scale difference regarding the each of the target sub-pixel data, and obtaining the corresponding third pixel data, wherein the corresponding third pixel data comprises the gray-scale difference regarding each of the target sub-pixel data, and the reference sub-pixel data.

2. The display adjustment method according to claim 1, wherein the step of calculating a gray-scale difference between each of the target sub-pixel data and the reference sub-pixel data, and obtaining the corresponding third pixel data includes:

performing a difference between each of the target sub-pixel data and the reference sub-pixel data to obtain a corresponding plurality of gray-scale differences;

converting each of the gray-scale differences into a gray-scale difference whose amount of the stored data is reduced relative to the second pixel data; and treating the converted plurality of gray-scale differences and the reference sub-pixel data as a third pixel data.

3. The display adjustment method according to claim 1, wherein the step of converting at least one of the second pixel data into sub-pixel data whose amount of stored data is reduced relative to the second pixel data to obtain a corresponding third pixel data includes:

treating two sub-pixel data in the second pixel data as reference sub-pixel data, and treating other sub-pixel data as a target sub-pixel data; and calculating a gray-scale difference between the target sub-pixel data and one of the reference sub-pixel data, and obtaining a corresponding third pixel data according to the gray-scale difference and the reference sub-pixel data.

4. The display adjustment method according to claim 3, wherein the step of calculating a gray-scale difference between the target sub-pixel data and one of the reference sub-pixel data, and obtaining a corresponding third pixel data according to the gray-scale difference and the reference sub-pixel data specifically includes:

performing difference between the target sub-pixel data and one of the reference sub-pixel data to obtain a corresponding gray-scale difference;

converting the gray-scale difference into a gray-scale difference whose amount of the stored data is reduced relative to the second pixel data; and treating the converted gray-scale difference and the reference sub-pixel data as a third pixel data.

5. The display adjustment method according to claim 1, wherein the amount of stored data of the first pixel data is 8 bits.

6. The display adjustment method according to claim 1, wherein the amount of stored data of the second pixel data is 10 bits.

7. A display adjustment method, wherein the display adjustment method comprises the steps of:

obtaining a first pixel data of an image displayed by the display device;

converting the first pixel data into a second pixel data after the first pixel data enters a timing controller, wherein the amount of stored data of the second pixel data is greater than the amount of stored data of the first pixel data;

calculating a first gray-scale difference between a first sub-pixel data and a second sub-pixel data in the second pixel data, and a second gray-scale difference between the second sub-pixel data and a third sub-pixel data;

replacing the first sub-pixel data with the first gray-scale difference and replacing the second sub-pixel data with the second gray-scale difference, obtaining a corresponding third pixel data, wherein the corresponding third data comprises the first and second gray-scale differences and the third sub-pixel data; and outputting the third pixel data.

8. The display adjustment method according to claim 7, wherein the step of obtaining a corresponding third pixel data according to the first and second the gray-scale differences and the third sub-pixel data specifically includes:

converting the gray-scale difference into a gray-scale difference whose amount of the stored data is reduced relative to the second pixel data; and treating the converted gray-scale difference and the third sub-pixel data as a third pixel data.

9. The display adjustment method according to claim 7, wherein the gray-scale difference between the first sub-pixel data and the second sub-pixel data is non-negative, and the gray-scale difference between the second sub-pixel data and the third sub-pixel data is non-negative.

10. The display adjustment method according to claim 7, wherein the first sub-pixel data is red sub-pixel data, the second sub-pixel data is green sub-pixel data, and the third sub-pixel data is blue sub-pixel data.

11. The display adjustment method according to claim 7, wherein the gray-scale difference between the first sub-pixel data and the second sub-pixel data is less than or equal to 127, and the gray-scale difference between the second sub-pixel data and the third sub-pixel data is less than or equal to 127.

12. A display device, wherein the display device comprises a memory, a processor, and a display adjustment program stored on the memory and operable on the processor, the processor executing the display adjustment program to implement the steps of:

obtaining a first pixel data of an image displayed by the display device;

converting the first pixel data into a second pixel data after the first pixel data enters a timing controller, wherein the amount of stored data of the second pixel data is greater than the amount of stored data of the first pixel data;

converting at least one of the second pixel data into sub-pixel data whose amount of stored data is reduced relative to the second pixel data to obtain a corresponding third pixel data; and outputting the third pixel data, and wherein the step of converting at least one of the second pixel data into sub-pixel data whose amount of stored data is reduced relative to the second pixel data to obtain a corresponding third pixel data comprises:

treating at least one sub-pixel data in the second pixel data as reference sub-pixel data, and treating other sub-pixel data as a target sub-pixel data; and calculating a gray-scale difference between each of the target sub-pixel data and one of the reference sub-pixel data, and replacing the each of the target sub-pixel data with the gray-scale difference regarding the each of the target sub-pixel data, and obtaining the corresponding third pixel data, wherein the corresponding third pixel data comprises the gray-scale difference regarding each of the target sub-pixel data, and the reference sub-pixel data.

13. The display device according to claim 12, wherein the processor executing the display adjustment program to implement the steps of:

performing difference between each of the target sub-pixel data and the reference sub-pixel data to obtain a corresponding plurality of gray-scale differences;

converting each of the gray-scale differences into a gray-scale difference whose amount of the stored data is reduced relative to the second pixel data; and treating the converted plurality of gray-scale differences and the reference sub-pixel data as a third pixel data.

14. The display device according to claim 12, wherein the processor executing the display adjustment program to implement the steps of:

treating two sub-pixel data in the second pixel data as reference sub-pixel data, and treating other sub-pixel data as a target sub-pixel data; and calculating a gray-scale difference between the target sub-pixel data and one of the reference sub-pixel data, and obtaining a corresponding third pixel data according to the gray-scale difference and the reference sub-pixel data.

15. The display device according to claim 14, wherein the processor executing the display adjustment program to implement the steps of:

performing difference between the target sub-pixel data and one of the reference sub-pixel data to obtain a corresponding gray-scale difference;

converting the gray-scale difference into a gray-scale difference whose amount of the stored data is reduced relative to the second pixel data; and treating the converted gray-scale difference and the reference sub-pixel data as a third pixel data.

16. The display device according to claim 12, wherein the amount of stored data of the first pixel data is 8 bits.

17. The display device according to claim 12, wherein the amount of stored data of the second pixel data is 10 bits.

18. The display device according to claim 12, wherein the display device further comprises a display panel and a circuit board, the display panel being connected to the circuit board, the display adjustment program being disposed on the circuit board.

* * * * *